US009705177B1

(12) United States Patent
Schmidt et al.

(10) Patent No.: US 9,705,177 B1
(45) Date of Patent: Jul. 11, 2017

(54) ANTENNA MOUNT SYSTEM AND METHODS FOR SMALL CELL DEPLOYMENT

(71) Applicant: SPRINT COMMUNICATIONS COMPANY, L.P., Overland Park, KS (US)

(72) Inventors: Patrick Jacob Schmidt, Basehor, KS (US); Wilbur E. Hill, Lee's Summit, MO (US); Chaitanya Chukka, Overland Park, KS (US); Andrew Mark Wurtenberger, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 7 days.

(21) Appl. No.: 14/809,566

(22) Filed: Jul. 27, 2015

(51) Int. Cl.
*H01Q 3/04* (2006.01)
*H01Q 1/18* (2006.01)

(52) U.S. Cl.
CPC ..... *H01Q 1/18* (2013.01); *H01Q 3/04* (2013.01)

(58) Field of Classification Search
CPC ..... H01Q 1/18; H01Q 3/04; H01Q 1/12
USPC ..... 343/763
See application file for complete search history.

(56) References Cited

U.S. PATENT DOCUMENTS

| | | | | |
|---|---|---|---|---|
| 2,924,824 | A * | 2/1960 | Lanctot | H01Q 1/18 343/765 |
| 3,789,414 | A * | 1/1974 | Bauer | H01Q 1/18 343/761 |
| 4,292,861 | A * | 10/1981 | Thornhill, Jr. | G01C 9/00 102/401 |
| 5,512,912 | A * | 4/1996 | Ross | H01Q 1/18 343/709 |
| 8,023,826 | B2 * | 9/2011 | Fasshauer | H01Q 1/1242 398/115 |
| 8,604,999 | B2 | 12/2013 | Abumrad et al. | |
| 2011/0309996 | A1 * | 12/2011 | Abumrad | H01Q 1/24 343/872 |
| 2015/0349399 | A1 * | 12/2015 | Lasier | F16L 3/26 343/721 |

* cited by examiner

*Primary Examiner* — Dameon E Levi
*Assistant Examiner* — David Lotter

(57) ABSTRACT

Antenna mount systems and methods for deploying small cells are disclosed. The antenna mount system may include an outer housing and an inner antenna enclosure at least partly positioned inside the outer housing, with the inner antenna enclosure movably coupled to the outer housing. The antenna mount system can include an orientation member that can aid in maintaining a particular orientation of an antenna so as to maintain a radiation pattern substantially on a defined area, independent of the position of the antenna mount system.

15 Claims, 3 Drawing Sheets

ANTENNA MOUNT SYSTEM AND METHODS FOR SMALL CELL DEPLOYMENT

SUMMARY

A high level overview of various aspects of the invention is provided here for that reason, to provide an overview of the disclosure and to introduce a selection of concepts that are further described below in the detailed-description section. This summary is not intended to identify key features or essential features of the claimed subject matter, nor is it intended to be used as an aid in isolation to determine the scope of the claimed subject matter.

In brief, and at a high level, this disclosure describes, among other things, antenna mount systems and methods for deploying small cells. For instance, in one embodiment, an antenna mount system can include an outer housing and an inner antenna enclosure at least partly positioned inside the outer housing, with the inner antenna enclosure movably coupled to the outer housing. In this embodiment, the antenna mount system can also include an orientation member. As explained herein, the orientation member and the inner antenna enclosure can facilitate maintaining a radiation pattern of an antenna substantially on a defined area independent of the position of the antenna mount system, when the antenna mount system is connected to a deployment object.

BRIEF DESCRIPTION OF THE DRAWINGS

Illustrative embodiments of the present invention are described in detail below with reference to the attached drawing figures, and wherein.

DETAILED DESCRIPTION

Figure 1:
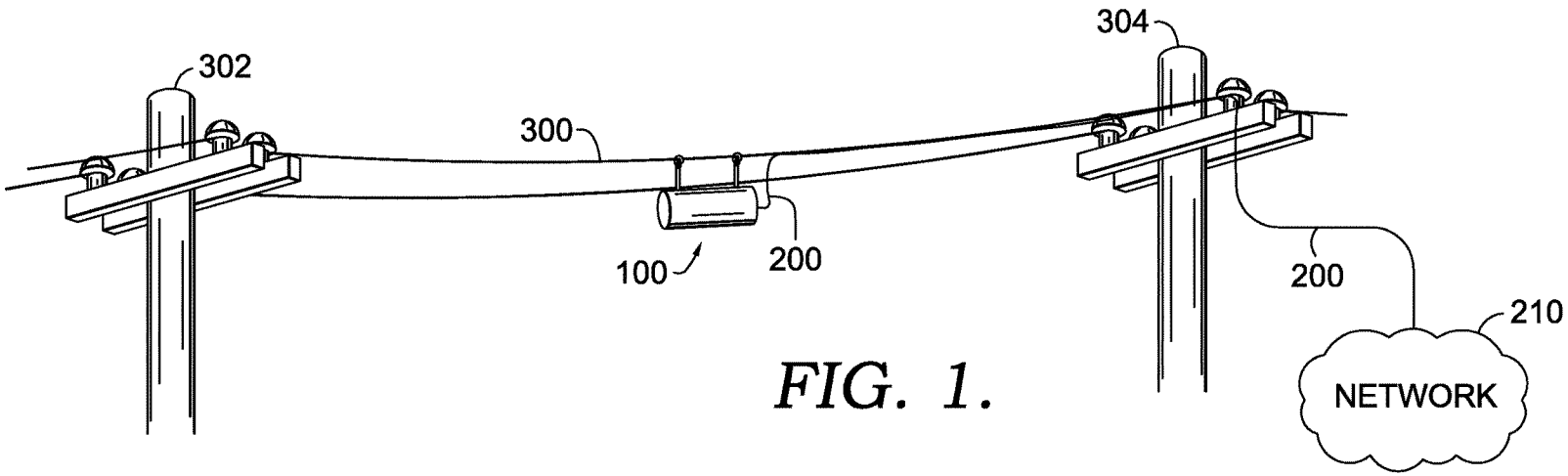
FIG. 1 depicts an antenna mount system connected to a support wire, where the support wire is positioned between two utility poles, according to an embodiment of the present invention.

The subject matter of select embodiments of the present invention is described with specificity herein to meet statutory requirements. However, the description itself is not intended to define what we regard as our invention, which is what the claims do.

Throughout this disclosure, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the present invention. The following is a list of these acronyms:

| | |
|---|---|
| LTE | Long Term Evolution |
| LTE-A | Long Term Evolution Advanced |
| GSM | Global System for Mobile Communications |
| GPRS | General Packet Radio Service |
| UMTS | Universal Mobile Telecommunications System |
| WiMAX | Worldwide Interoperability for Microwave Access |
| eNodeB | Evolved Node B |

Further, various technical terms are used throughout this description. An illustrative resource that fleshes out various aspects of these terms can be found in Newton's Telecom Dictionary, 27th Edition (2012).

To address gaps in macro-network coverage (e.g., in or between buildings), to provide additional network capacity in congested areas, and for other reasons, macro-network service providers may deploy devices referred to herein as small cells, which may also be referred to as femtocells, picocells, microcells, low-cost internet base stations (LCIBs), and by other names.

Small cells may be deployed inside buildings or outdoors, depending on the area where coverage is desired. For various reasons, when installing small cells outdoors, it may be desirable to utilize existing structures for attaching small cells thereto. For example, in certain deployment scenarios, small cells may be attached to existing cables or wires that are strung between two utility poles. However, in such a deployment scenario, the weather, such as the wind, can cause the small cell to sway on the supporting cable or wire, which may affect the coverage area or signal intended to be provided by the small cell. For this and other reasons, it would be beneficial to have a system for mounting a small cell antenna that can allow a small cell antenna to maintain a particular orientation in order to provide coverage to a desired area.

Accordingly, in one aspect, the present invention is directed to an antenna mount system that includes an outer housing having a connection member for connecting an antenna mount system to a deployment object. The antenna mount system can also include an inner antenna enclosure at least partly positioned inside the outer housing, where the inner antenna enclosure is movably coupled to the outer housing. An antenna can be positioned inside the inner antenna enclosure, where the antenna is configured to provide a radiation pattern to a defined area. The antenna mount system also includes an orientation member, where, when the antenna mount system is connected to the deployment object, the inner antenna enclosure, the antenna, and the orientation member are cooperatively configured to maintain the radiation pattern substantially on the defined area, independent of the position of the antenna mount system relative to the deployment object.

In another aspect, the present invention is directed to an antenna mount system for small cell deployment. The antenna mount system includes an outer housing having a connection member for connecting an antenna mount system to a support wire, and an inner antenna enclosure positioned inside the outer housing, where the inner antenna enclosure is rotatably coupled to the outer housing. The antenna mount system also includes an orientation member configured to facilitate the rotation of the inner antenna enclosure relative to the outer housing, when the antenna mount system is connected to the support wire and radially moves relative to the support wire.

In yet another aspect, the present invention includes a method for deploying one or more small cells. The method includes providing an antenna amount system. The antenna mount system includes an outer housing having a connection member for connecting an antenna mount system to a deployment object. The antenna mount system can also include an inner antenna enclosure at least partly positioned inside the outer housing, where the inner antenna enclosure is movably coupled to the outer housing. An antenna can be positioned inside the inner antenna enclosure, where the antenna is configured to provide a radiation pattern to a defined area. The antenna mount system also includes an orientation member, where, when the antenna mount system is connected to the deployment object, the inner antenna enclosure, the antenna, and the orientation member are cooperatively configured to maintain the radiation pattern substantially on the defined area, independent of the position of the antenna mount system relative to the deployment object. The method further includes connecting the antenna amount system to the deployment object.

Turning now to FIG. 1, one embodiment of an antenna mount system 100 is depicted. In embodiments, the antenna mount system 100 may be used to deploy small cells in various locations, such as locations outdoors. The antenna mount system 100 depicted in FIG. 1 may be mounted to a support wire 300 that is strung between two utility poles 302 and 304. It is appreciated that the support wire 300 strung between the utility poles 302 and 304 is but one example of an outdoor structure for mounting the antenna mount system 100, and that many other types of outdoor structures can be utilized for mounting the antenna mount system 100. The support wire 300 can be a pre-existing utility wire, such as an electrical, telephone, or cable wire. In certain embodiments, the support wire 300 may not be a pre-existing wire and may be installed along with the antenna mount system 100 in order to provide a dedicated support wire for mounting the antenna mount system 100. It is further appreciated that the utility poles 302 and 304 can be any type of utility poles or other structures capable of securing a support wire.

In certain embodiments, such as that depicted in FIG. 1, the antenna mount system 100 can be connected to the network 210 via a connection line 200. The connection line 200 can provide power and/or data to one or more components, such as an antenna, associated with the antenna mount system 100. In one or more embodiments, the connection line 200 may be associated with, or part of, the support wire 300. The connection line 200 may be a wired connection to the nearest base station or a direct landline connection.

The network 210 is not limited to a particular type of network. A non-limiting list of possible networks can include LTE, LTE-A, GSM, GPRS, UMTS, and WiMAX. In embodiments, the network 210 may include components to facilitate data transmission to and from an antenna or other component associated with the antenna mount system 100 and the network 210, such as a base station controller or an eNodeB.

The antenna mount system 100 will now be described in more detail, with reference to FIGS. 2 and 3. It is appreciated that the antenna mount system 100 is just one example of an antenna mount system, and that other types of systems and structures having similar functionality to that described herein are within the scope of this disclosure.

Figure 3:
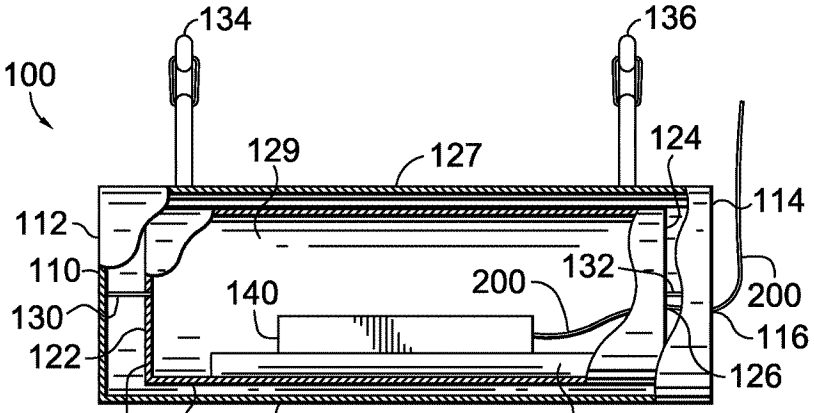
FIG. 3 depicts a side view of the antenna mount system of FIG. 2, with a portion of both the outer housing and the inner antenna enclosure removed to reveal the antenna and the orientation member, according to an embodiment of the present invention.
Figure 2:
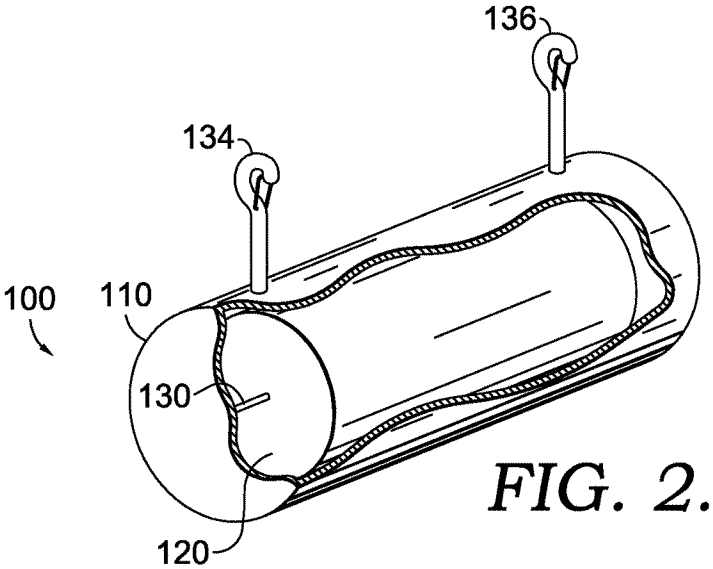
FIG. 2 depicts a perspective view of the antenna mount system of FIG. 1, with a portion of the outer housing removed to reveal the inner antenna enclosure, according to an embodiment of the present invention.

The antenna mount system 100 of FIGS. 2 and 3 can include an outer housing 110. In embodiments, the outer housing 110 can be made from any type of material that is able to withstand the outdoor elements, such as sun exposure, wind, hail, snow, and/or rain. In one or more embodiments, the outer housing 110 can be made from a material that does not adversely affect the function of any components of a small cell, such as an antenna. In certain embodiments, the outer housing 110 may be made from a plastic or plastic-type material. While, in the figures, the outer housing 110 is depicted as a cylindrical shape, it is appreciated that the outer housing 110 can be other shapes that are suitable for deploying small cells.

As depicted in FIGS. 2 and 3, an inner antenna enclosure 120 may be positioned inside, or at least partly inside, the outer housing 110. The inner antenna enclosure 120 can be made from the same material discussed above with respect to the outer housing 110.

In embodiments, the inner antenna enclosure 120 can be movably coupled to the outer housing 110. For example, as shown in FIGS. 2 and 3, the inner antenna enclosure 120 may be coupled to the outer housing 110 via two coupling members 130 and 132. In embodiments, the coupling members 130 and 132 can be any type of coupling members capable of coupling the inner antenna enclosure 120 to the outer housing 110, as long as the inner antenna enclosure 120 is capable of moving relative to the outer housing 110.

In embodiments, such as that depicted in FIGS. 2 and 3, the coupling members 130 and 132 may be pins that may be fixedly coupled to the ends 112 and 114 of the outer housing 110, respectively. In such embodiments, the coupling members 130 and 132 can also be coupled to the ends 122 and 124 of the inner antenna enclosure 120, respectively, such that the inner antenna enclosure 120 can rotate about the coupling members 130 and 132. In certain embodiments not depicted in the figures, the inner antenna enclosure 120 can include ball bearings on each end 122 and 124 to facilitate the rotation of the inner antenna enclosure 120 about the coupling members 130 and 132.

In embodiments, other mechanisms can be utilized to movably couple the inner antenna enclosure 120 to the outer housing 110. For example, in one embodiment, the coupling members 130 and 132 can be fixed to the ends 122 and 124 of the inner antenna enclosure 120, respectively, while the ends 112 and 114 of the outer housing 110 may include ball bearings to facilitate the rotation of the inner antenna enclosure 120 relative to the outer housing 110. As another example, in one or more embodiments not depicted in the figures, the outer housing 110 can include a track to engage at least a portion of the inner antenna enclosure 120 such that the inner antenna enclosure 120 can move relative to the outer housing 110. It is appreciated that there are a number of mechanisms that can be used so that the inner antenna enclosure 120 can be movably coupled to the outer housing 110, and a particular mechanism can be chosen by one skilled in the art for a specific purpose.

In certain embodiments, the antenna mount system 100 can include one or more components of a small cell. For example, in the embodiment depicted in FIG. 3, the inner antenna enclosure 120 can include an antenna 140. In such embodiments, the antenna 140 can be configured to provide coverage to a defined area when the antenna mount system 100 is deployed, e.g., connected to a deployment object. Any type of commercially available antenna for telecommunications and/or data transmission and receipt can be utilized in the antenna mount system 100. In certain embodiments, a small cell antenna may be utilized in the antenna mount system 100.

Although not shown in the figures, it is appreciated that additional components for small cell deployment may also be present in the antenna mount system 100. For example, in one or more embodiments, a transceiver may be positioned inside the antenna mount system 100. In such embodiments, the transceiver may be configured for transmitting signals to and from an antenna, e.g., the antenna 140 of FIG. 3.

As discussed above, the antenna mount system 100 may be connected to a network, e.g., the network 210 of FIG. 1. In such embodiments, each of the inner antenna enclosure 120 and the outer housing 110 may include a through opening, 126 and 116, respectively, for receiving at least a portion of a connection line 200 for connecting to a network. In such embodiments, the through openings 126 and 116 can be configured to allow for the rotation of the connection line 200 as the inner antenna enclosure 120 rotates relative to the outer housing 110, e.g., by having large enough openings so as to not restrict the movement of the inner antenna enclosure 120 relative to the outer housing 110. Further, it is appreciated that the connection line 200 may be flexible enough to allow for the movement of the inner antenna enclosure 120 and/or the outer housing 110.

In one or more embodiments, the antenna mount system 100 can include one or more connection members 134 and 136 to connect the antenna mount system 100 to a deployment object, e.g., the support line 300 depicted in FIG. 1. The connection members 134 and 136 can be any type of commercially available connection members or devices, as long as such devices can securely connect the outer housing 110 to a support wire, e.g., the support wire 300.

In one or more embodiments, as discussed above, the antenna mount system 100 may include an orientation member 150. In certain embodiments, the orientation member 150 may at least partly facilitate the movement of the inner antenna enclosure 120 relative to the outer housing 110, and/or may aid in maintaining a particular orientation of the inner antenna enclosure 120 relative to the ground as the antenna mount system 100 moves. In such embodiments, as discussed further below with respect to FIGS. 4 and 5, this independent movement of the inner antenna enclosure 120 allows for the antenna 140 to maintain a radiation pattern on a particular, defined area even when the antenna mount system 100 moves, e.g. from being blown in the wind.

The orientation member 150 can be made from any material, such as a plastic or a rubber material, as long as such a material does not interfere with the function of any components of a small cell, such as an antenna.

In embodiments, such as that depicted in FIG. 3, the orientation member 150 can be distinct from the inner antenna enclosure 120. In such embodiments, the orientation member 150 may be positioned to the interior 129 of the inner antenna enclosure 120 or exterior to the inner antenna enclosure 120, e.g. on the outer surface 121 of the inner antenna enclosure 120. In certain embodiments, the orientation member 150 can be integral with the inner antenna enclosure 120. For example, in such embodiments, the orientation member 150 may comprise at least a portion of the bottom side 128 of the inner antenna enclosure 120, such as a thickened bottom side 128 relative to the top side 127. The term "orientation member," as used herein, is meant to apply to embodiments where the orientation member 150 is distinct from the inner antenna enclosure 120 and to embodiments where the orientation member 150 is integral with the inner antenna enclosure 120.

In embodiments, the orientation member 150 may provide an uneven weight distribution to the inner antenna enclosure 120 so as to cause or facilitate the inner antenna enclosure 120 to move relative to the outer housing 110, and/or to maintain a particular orientation of the inner antenna enclosure 120 relative to the ground when the antenna mount system 100 moves. In such embodiments, this uneven weight distribution of the inner antenna enclosure 120 may cause or facilitate the rotation of the inner antenna enclosure 120 about the coupling members 130 and 132. Further, in such embodiments, this uneven weight distribution of the inner antenna enclosure 120 can at least partly facilitate providing a radiation pattern from the antenna 140 to a fixed, defined area independent of the position of the antenna mount system 100, when deployed.

Figure 4:
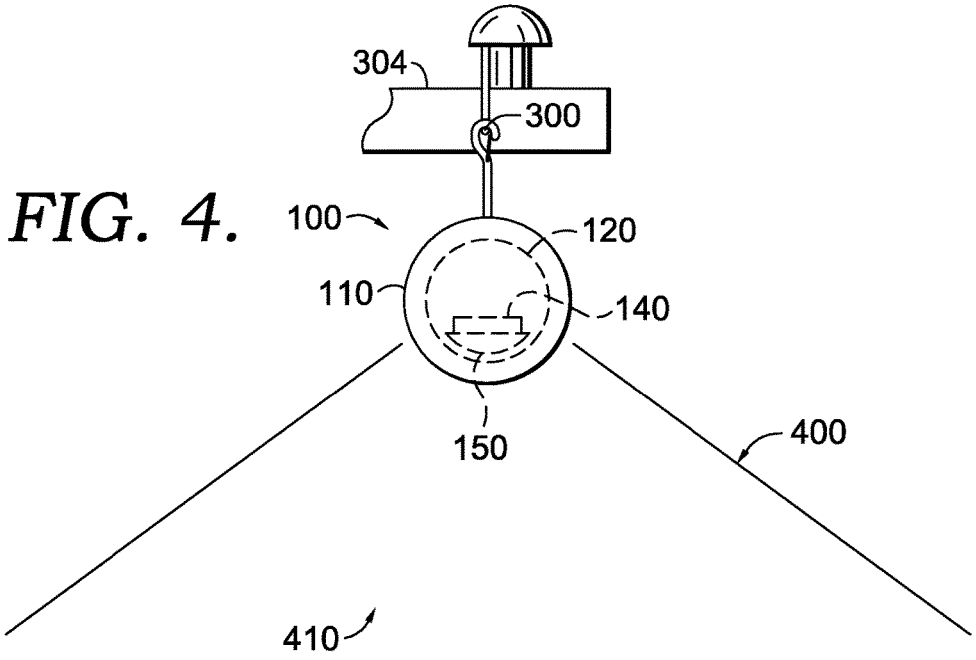
FIG. 4 depicts a side view of an antenna mount system connected to a support wire, with a schematic representation of an antenna radiation pattern in a defined area, according to an embodiment of the present invention.
Figure 5:
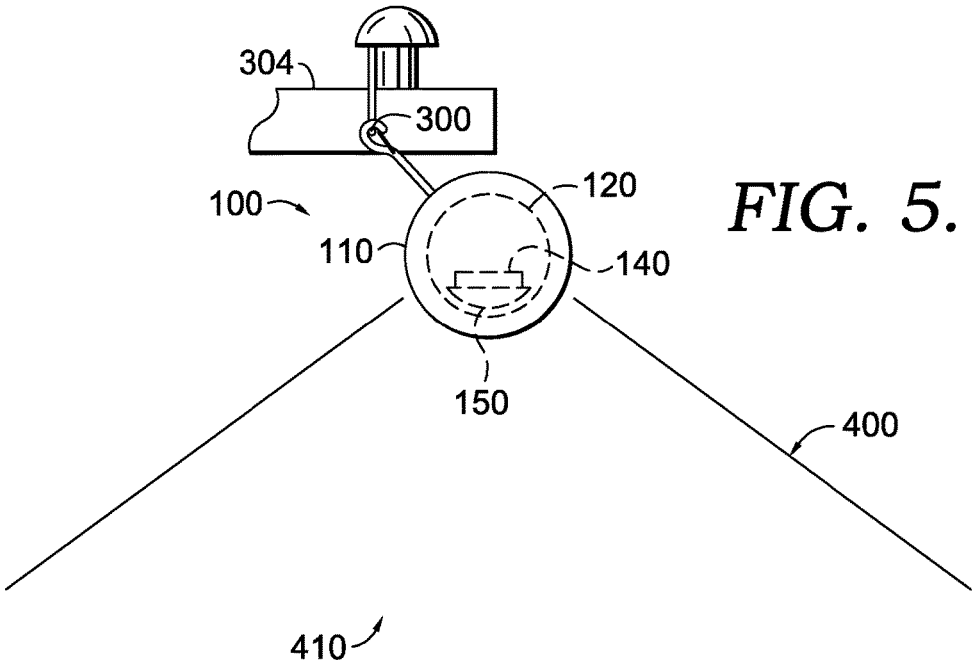
FIG. 5 depicts a side view of an antenna mount system connected to a support wire, with a schematic representation of an antenna radiation pattern in a defined area, where the antenna mount system is in an alternative position compared to the position in FIG. 4, according to one embodiment of the present invention.

The embodiment depicted in FIGS. 4 and 5 provide one example of how the antenna mount system 100 can maintain a radiation pattern 400, e.g., from an antenna 140, in a defined area 410. In embodiments, the radiation pattern 400 may be provided by the antenna 140 in order to transmit and receive telecommunications and/or data transmissions. In one or more embodiments, the defined area 410 may be an area chosen for deployment of a small cell to provide network coverage.

As can be seen in the embodiment depicted in FIGS. 4 and 5, the antenna mount system 100 is mounted onto a support wire 300 that is connected to at least a portion of a utility pole 304. FIG. 4 depicts the antenna mount system 100 in a first position relative to the support wire 300, while FIG. 5 depicts the antenna mount system 100 in a second position relative to the support wire 300. In one embodiment, the antenna mount system 100 can radially move from a first position relative to the support wire 300 (e.g., FIG. 4) to a second position relative to the support wire 300 (e.g., FIG. 5). In such embodiments, this movement of the antenna mount system 100 from a first position to a second position relative to a support wire 300, or other deployment object, can be at least partly caused by outside elements, such as wind.

As depicted in FIG. 4, the antenna 140 may provide a radiation pattern 400 to a defined area 410. As seen in the embodiment depicted in FIG. 5, the antenna mount system 100 has moved relative to its position in FIG. 4; however, the antenna mount system 100 of FIG. 5 may be configured to substantially maintain the radiation pattern 400 of the antenna 140 in the same defined area 410. In embodiments, as discussed above, when the antenna mount system 100 moves relative to the support wire 300, or other deployment object, the inner antenna enclosure 120 can move relative to the outer housing 110 in such a manner that the antenna 140 may substantially maintain the radiation pattern 400 in the defined area 410. In embodiments, substantially maintaining the radiation pattern 400 of the antenna 140 in the same defined area 410 can mean that the antenna 140 can provide usable network coverage to at least 50%, 75%, 85%, 90% or 95% of the defined area 410. In certain embodiments, when the antenna mount system 100 moves relative to the support wire 300, or other deployment object, the antenna mount system 100 may be configured to aid the antenna 140 in maintaining a radiation pattern 400 in the defined area 410 such that the antenna power within the defined area 410 is about less than 7 dB, 6 dB, 5 dB, 4 dB, 3 dB, 2 dB, or 1 dB.

As discussed above, the antenna mount systems disclosed herein may be mounted on any type of deployment object.

Figure 6:
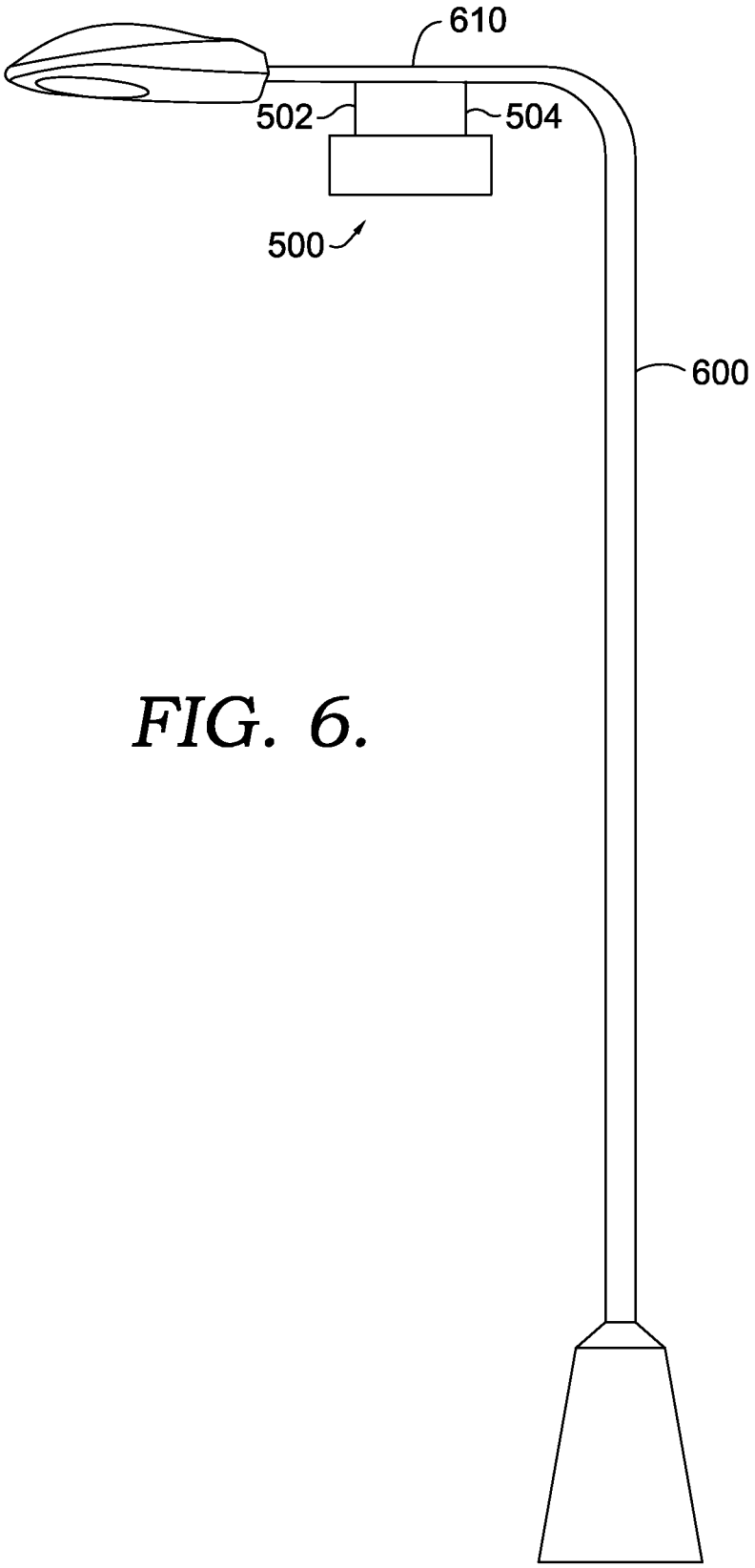
FIG. 6 depicts an antenna mount system connected to a portion of a street lamp, according to one embodiment of the present invention.

For example, FIG. 6 depicts an antenna mount system 500 connected to a deployment object other than a support wire, e.g., other than the support wire 300 of FIG. 1. The antenna mount system 500 can have any or all of the properties and parameters of the antenna mount system 100 discussed above with reference to FIGS. 1-5. For example, in embodiments, the antenna mount system 500 is configured to maintain an antenna radiation pattern to a defined area even if the antenna mount system 500 moves.

In the embodiment depicted in FIG. 6, the antenna mount system 500 is connected to a portion 610 of a street lamp 600. In such embodiments, the antenna mount system 500 may include connection members 502 and 504 to connect the antenna mount system 500 to the street lamp 600. It is appreciated that the connection members 502 and/or 504 may be any type of connection members, and a particular type can be chosen by one skilled in the art for a specific purpose. Although not depicted in FIG. 6, the antenna mount system 500 may be connected (e.g., via a wired connection) to a network, such as the network 210 discussed above with reference to FIG. 1.

In embodiments, a method for deploying one or more small cells can include providing an antenna mount system, such as the antenna mount system 100 or the antenna mount system 500 discussed above with reference to any or all of the respective FIGS. 1-6. In such embodiments, a method for deploying one or more small cells can further include connecting the antenna mount system 100 or 500 to a deployment object, such as any of the deployment objects discussed herein.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An antenna mount system comprising:

an outer housing having a connection member for connecting an antenna mount system to a deployment object;

an inner antenna enclosure positioned inside the outer housing, wherein the inner antenna enclosure is movably coupled to the outer housing;

an antenna positioned inside the inner antenna enclosure, the antenna configured to provide a radiation pattern to a defined area while positioned inside the inner antenna enclosure; and an orientation member, wherein, when the antenna mount system is connected to the deployment object, the inner antenna enclosure, the antenna, and the orientation member are cooperatively configured to maintain the radiation pattern substantially on the defined area while the antenna is positioned inside the inner antenna enclosure, independent of the position of the antenna mount system relative to the deployment object.

2. The antenna mount system according to claim 1, wherein the orientation member is configured to provide an uneven weight distribution to the inner antenna enclosure such that the uneven weight distribution at least partly causes the inner antenna enclosure to move relative to the outer housing.

3. The antenna mount system according to claim 1, wherein the deployment object comprises a support wire associated with at least one utility pole.

4. The antenna mount system according to claim 1, wherein the deployment object comprises at least a portion of a street lamp or street lamp pole.

5. The antenna mount system according to claim 1, wherein the antenna comprises a small cell antenna.

6. The antenna mount system according to claim 1, wherein both the outer housing and the inner antenna enclosure comprise a through-opening configured to receive at least a portion of a power or data cable for the antenna.

7. The antenna mount system according to claim 1, wherein, when the antenna mount system is connected to the deployment object, the inner antenna enclosure, the antenna, and the orientation member are cooperatively configured to maintain a signal strength of the radiation pattern in the defined area that is less than about 3 dB, independent of the position of the antenna mount system relative to the deployment object.

8. An antenna mount system for small cell deployment, the antenna mount system comprising:

an outer housing having a connection member for connecting an antenna mount system to a support wire;

an inner antenna enclosure positioned inside the outer housing, wherein the inner antenna enclosure is rotatably coupled to the outer housing;

a small cell antenna positioned inside the inner antenna enclosure, the small cell antenna configured to provide a radiation pattern to a defined area while positioned inside the inner antenna enclosure; and an orientation member configured to facilitate the rotation of the inner antenna enclosure relative to the outer housing, when the antenna mount system is connected to the support wire and radially moves relative to the support wire, so that the small cell antenna positioned inside the inner antenna enclosure can maintain the radiation pattern substantially on the defined area independent of the position of the antenna mount system relative to the support wire.

9. The antenna mount system according to claim 8, wherein the orientation member is configured to provide an uneven weight distribution to the inner antenna enclosure such that the uneven weight distribution at least partly causes the inner antenna enclosure to rotate relative to the outer housing, when the antenna mount system is connected to the support wire and radially moves relative to the support wire.

10. The antenna mount system according to claim 8, wherein the support wire is associated with at least one utility pole.

11. A method for deploying one or more small cells comprising:

providing an antenna mount system, the antenna mount system comprising:

an outer housing having a connection member for connecting the antenna mount system to a deployment object;

an inner antenna enclosure positioned inside the outer housing, wherein the inner antenna enclosure is movably coupled to the outer housing;

an antenna positioned inside the inner antenna enclosure, the antenna configured to provide a radiation pattern to a defined area while positioned inside the inner antenna enclosure; and an orientation member, wherein, when the antenna mount system is connected to the deployment object, the inner antenna enclosure, the antenna, and the orientation member are cooperatively configured to maintain the radiation pattern substantially on the defined area while the antenna is positioned inside the antenna enclosure, independent of the position of the antenna mount system relative to the deployment object; and connecting the antenna amount system to the deployment object.

12. The method according to claim 11, wherein the deployment object comprises a support wire associated with at least one utility pole.

13. The method according to claim 11, wherein the antenna comprises a small cell antenna.

14. The method according to claim 11, wherein the inner antenna enclosure, the antenna, and the orientation member are cooperatively configured to maintain a signal strength of the radiation pattern in the defined area that is less than about 3 dB, independent of the position of the antenna mount system relative to the deployment object.

15. The method according to claim 11, wherein the orientation member is configured to provide an uneven weight distribution to the inner antenna enclosure such that the uneven weight distribution at least partly causes the inner antenna enclosure to move relative to the outer housing.

* * * * *